US006053019A

United States Patent [19]

Wiik et al.

[11] Patent Number: 6,053,019

[45] Date of Patent: Apr. 25, 2000

[54] ARRANGEMENT IN A LOCK, ESPECIALLY AN ELECTROMECHANICAL LOCKING SYSTEM

[75] Inventors: Tore H. Wiik; Tor Sørnes, both of Moss, Norway

[73] Assignee: VingCard AS, Norway

[21] Appl. No.: 08/869,095

[22] Filed: Jun. 4, 1997

[30] Foreign Application Priority Data

Jun. 13, 1996 [NO] Norway ..... 962508

[51] Int. Cl.[7] ..... E05B 47/06

[52] U.S. Cl. ..... 70/283; 70/279

[58] Field of Search ..... 70/276–283

[56] References Cited

U.S. PATENT DOCUMENTS

| | | | |
|---|---|---|---|
| 3,677,043 | 7/1972 | Cox | 70/283 X |
| 4,148,092 | 4/1979 | Martin | 361/172 |
| 4,529,234 | 7/1985 | Senften | 70/283 X |
| 4,633,687 | 1/1987 | Fane | 70/276 |
| 4,656,850 | 4/1987 | Tabata | 70/283 X |
| 4,671,084 | 6/1987 | Lin | 70/25 |
| 4,671,087 | 6/1987 | Olenfalk | 70/283 |
| 4,762,212 | 8/1988 | Fish et al. | 70/283 X |
| 4,979,383 | 12/1990 | Tully | 70/283 X |
| 4,995,248 | 2/1991 | Liu | 70/283 X |
| 5,437,174 | 8/1995 | Aydin | 70/278 |
| 5,475,996 | 12/1995 | Chen | 70/279 |
| 5,487,289 | 1/1996 | Otto, III et al. | 70/283 X |
| 5,640,863 | 6/1997 | Frolov | 70/283 |
| 5,715,715 | 2/1998 | Nunez | 70/283 |

FOREIGN PATENT DOCUMENTS

| | | |
|---|---|---|
| 283384 | 9/1988 | European Pat. Off. . |
| 152058 | 7/1982 | Norway . |
| 431890 | 3/1984 | Sweden . |
| 2089875 | 6/1982 | United Kingdom . |
| 2201452 | 9/1988 | United Kingdom . |

*Primary Examiner*—Suzanne Dino Barrett
*Attorney, Agent, or Firm*—Bierman, Muserlian and Lucas

[57] ABSTRACT

Arrangement in a lock, especially an electromechanical locking system, comprising a lock casing, as well as an electromagnetic stopper which influences the door handle, and for the purpose of providing a locking unit which inter alia meets the requirements regarding inside panic opening in connection with guest room doors for hotels or similar, especially in connection with locks having battery operation with limited energy. The electromagnetic stopper means is arranged on the inside of the door, the room side, and is so adapted that it allows the inner door handle to open the door independently of whether the door is barred against being opened from the outside.

8 Claims, 4 Drawing Sheets

ARRANGEMENT IN A LOCK, ESPECIALLY AN ELECTROMECHANICAL LOCKING SYSTEM

FIELD OF THE INVENTION

The present application relates to an arrangement in a lock, especially an electromechanical locking system, comprising a lock casing, as well as an electromagnetic stopper means which influences the door handle.

BACKGROUND OF THE INVENTION

The present invention relates to an electromechanical lock of the type which is extensively used in guest room is doors in hotels, but is also used for other types of doors. This type of lock is operated mostly by a magnetic card, punched card or metal key having an electronic code embedded therein. It can also be operated by traditional metal key of conventionally known type.

Door locks of this type is provided with three basic functions:

A) the physical blocking of the door in relation to the frame thereof so as to keep the door closed or allow opening thereof, B) the electromagnetic blocking/release of blocking in the lock or operating means, C) the code function taking the form of a key, key card, keyboard or other identification means.

The present invention relates to the location and the function of the electromechanical blocking function, as stated under item B) above.

PRIOR ART

The most usual and commonly known method of today is to locate said blocking function in the lock casing which is housed in the door. This method is inter alia disclosed in Norwegian patent specification 152.058. This involves a lock casing which is designed specifically for this aim, said lock casing being relatively large so as to house the necessary electromechanical mechanism. This design is unfavourable as regards the door owner. In most cases the installation of such a lock has namely been effected in an already existing door having a conventional lock. It may then be a prerequisite to use the already existing lock casing for thereby avoiding further counter sinking and adjustment of another lock casing. The present invention has for an object to eliminate this problem.

Another solution related to the function B) is to place the electromagnetic device in a casing on the outside of the door, in a so-called outer plate. This is disclosed in for example U.S. patent specifications No. 4,671,084 and No. 4,148,092. The prior art electromagnetic device influences the door handle or some other operating means by the locking thereof or by bringing a coupling means into or out of operation. The door handle will then be firmly blocked or released from the lock, depending on which solution is chosen. Also in connection with this solution including an electromagnetic operation in the outer plate, there are involved substantial weaknesses seen from the user's point of view. The outer plate will usually be large and dominating on the door, see for example U.S. patent specification No. 4,671,087, and this may be unwanted as seen from an aesthetic point of view. This solution is also more prone to vandalism and burglary. One problem relates in the fact that a plate having this mechanism on the outer side of the door, can more easily be manipulated by drilling a small hole in the outer plate for thereby influencing the blocking mechanism. The outside of the door, i.e. the corridor side thereof, is the most exposed location, which means that no sensitive mechanism should be related thereto.

A third problem is the exposure to climatic influences, precipitation and corrosive atmosphere which can easily attack a vulnerable inner mechanism. The present invention has for an object also to eliminate such deficiencies.

From SE 431 890 (Wallander) there is known a stopper means in an inner plate which is electrically operated, and which must be opened by means of electricity. When relieving the blocking from the inside the locking from the outside is released at the same time, which is not the purpose according to the present invention. This prior art solution is unfavourable as regards erroneous operation, consumption of electrical current and the possibility of manipulation. SE 431 890 is also silent about what is called a panic opening function. A lock including a panic opening function should allow for internal opening with a single grip independently of electrical power (batteries might be dead). This is a standard requirement in many countries.

GB 2 089 875-A (Wan-Li Lee) also relates to a lock structure which is operated electrically in connection with opening from the inside, but cannot be regarded as having a panic opening function. Consequently, this prior art structure will also be hampered with the same deficiencies as mentioned above.

GB 2 201 452-A (Hordijk et al.) discloses a motor-driven lock set which has some relation to the present invention. This prior art structure will allow an operation from the inside of the door to result in a mechanical opening of the door, at the same time as the electric motor is entrained by the movement. However, the prior art structure is hampered with severe limitations which makes the lock set unuseful in relation to the present invention. In connection with public doors, especially in hotels, there are handicap rules which require that a door is to be opened by means of a door handle having a certain length, named "California Standard" after the first state which implemented this, and not a round knob. The prior art structure will not fulfil this requirement because the suggested motor having a limited current source to be found in a door lock, will in practice not be able to pull a door knob, but is dependent upon a balanced operating means.

A prior art lock set as disclosed in GB 2 201 452 and being operated by a key from the outside and by a correspondingly balanced knob from the inside, can not be used for guest room doors in hotels, especially since this lock will not meet the requirement of panic opening related to guest room doors for hotels which are locked with battery power having a limited energy. In practice such batteries will comprise three small 1.5 V cells giving a voltage of 4.5 volts. The prior art structure comprises only a cylinder-key-knob lock which would require a door handle or a door knob including an associated locking mechanism in addition to the locking itself. The prior art lock set would also require a specific lock wherein the lock is of a two-part type, such that the operation involving a key from the outside and the operation involving a knob from the inside would not stop each other.

EP-0 283 384-A1 (Dentin) discloses a locking system which is similar to what has been described above, involving the same deficiencies and limitations. All functions seem to be built into the lock which in the prior art case is a project mounted lock.

OBJECTS OF THE INVENTION

An object of the present invention is to provide an arrangement in a lock, especially an electromechanical locking system, which can easily be implemented in ordinary built-in lock casings.

Another object of the present invention is to provide such a locking system which includes handicap favourable door handles or door knobs.

Still another object of the present invention is to provide such an electromagnetic locking system wherein the requirement of panic opening function is easily implemented.

Yet another object of the present invention is to provide an electromagnetic locking system wherein the requirement for panic opening function is included in guest room doors for hotels and locks having battery operation with limited sources.

Another object of the present invention is to provide an electromagnetic locking unit in which can be used an integral shaft through the lock casing, which is usual in connection with door handles and standard locks.

Still another object of the present invention is to provide an electromagnetic locking system which allows that the door can be operated from the inside in an ordinary manner when a usual door handle is operated, independently of whether the lock is barred against being opened from the outside.

SUMMARY OF THE INVENTION

The above objects are achieved in an arrangement of the type as stated in the preamble, which according to the present invention is characterized in that the electromagnetic stopper means is arranged on the inside of the door, the room side, and is so adapted that it allows the inner door handle to open the door independently of whether the door is barred against being opened from the outside.

In other words, the present invention paves the way for locating the electromagnetic stopping function on the inside of the door, so as to make it possible to use an existing lock casing in the door, and such as to reduce the climatic problems and any vandalism of this unit, for thereby increasing the security thereof. At the same time the invention devises an electromagnetic locking system which always allows the door handle to be operated from the inside, even if the outer door handle is in its blocked position. This is a requirement put forward from most hotel owners. The door handle should always be operable from the inside of the door, meeting the requirement of so-called panic opening, wherein all locking functions are released in one manual operation.

In brief, the principle according to the invention is manifested by an ordinary door-handle having its ordinary shaft going from the outside of the door through the lock and into a locking mechanism on the inside of the door. This locking mechanism has a connection with the door handle on the inside of the door, and this door handle will use its first degrees of rotation for releasing the locking before the lock and the outer door handle is entrained in the associated movement for thereby opening the door.

Further advantages and features of the present invention will appear from the following description taken in conjunction with the appended drawings.

BRIEF DISCLOSURE OF THE DRAWINGS

FIG. 1 is a vertical section through a door and through the middle of a door handle and associated lock casing.

FIG. 2 a horizontal section through the middle of the door handle and the lock casing.

DISCLOSURE OF EMBODIMENTS

Figure 1:
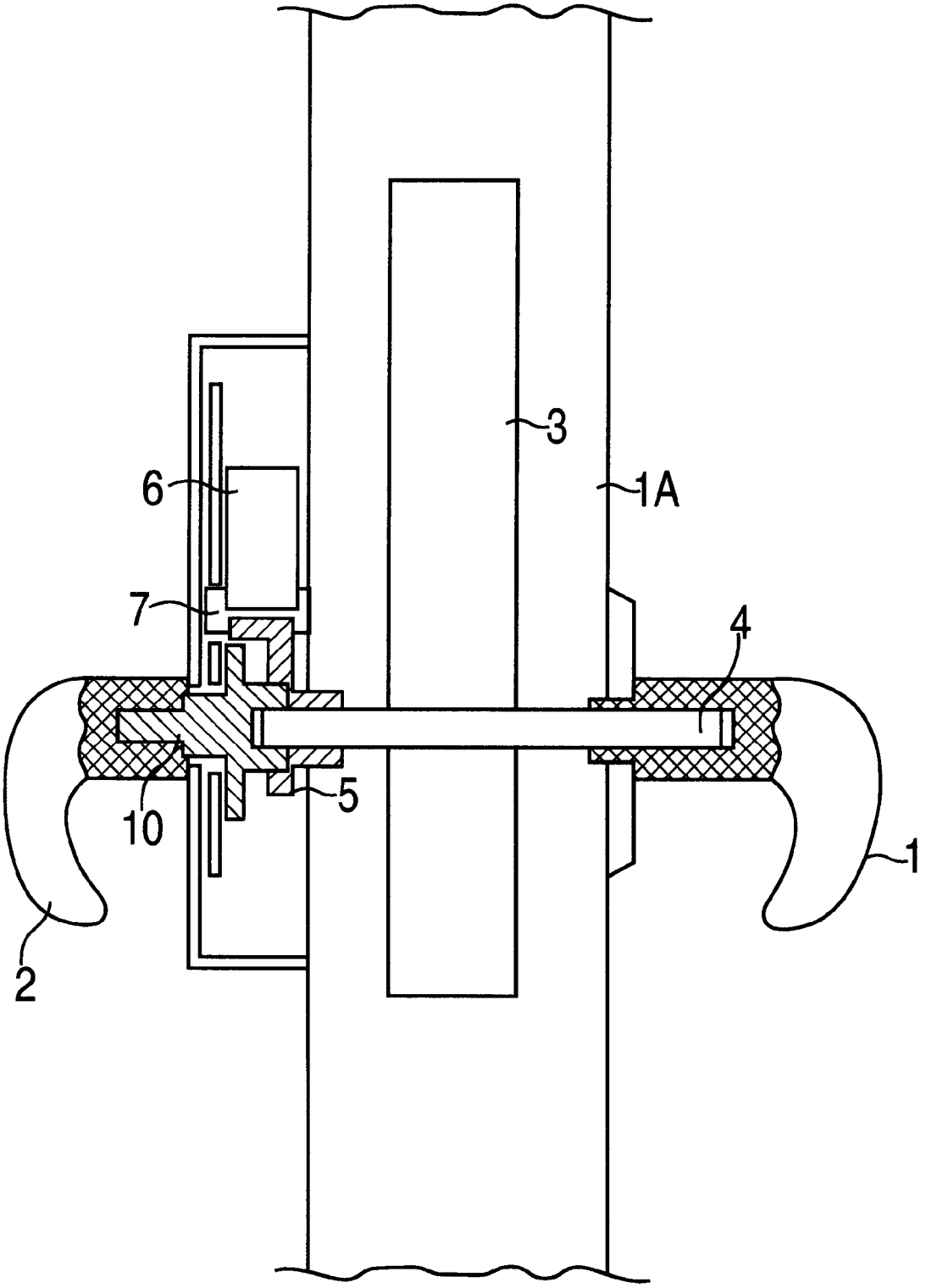
Figure 2:
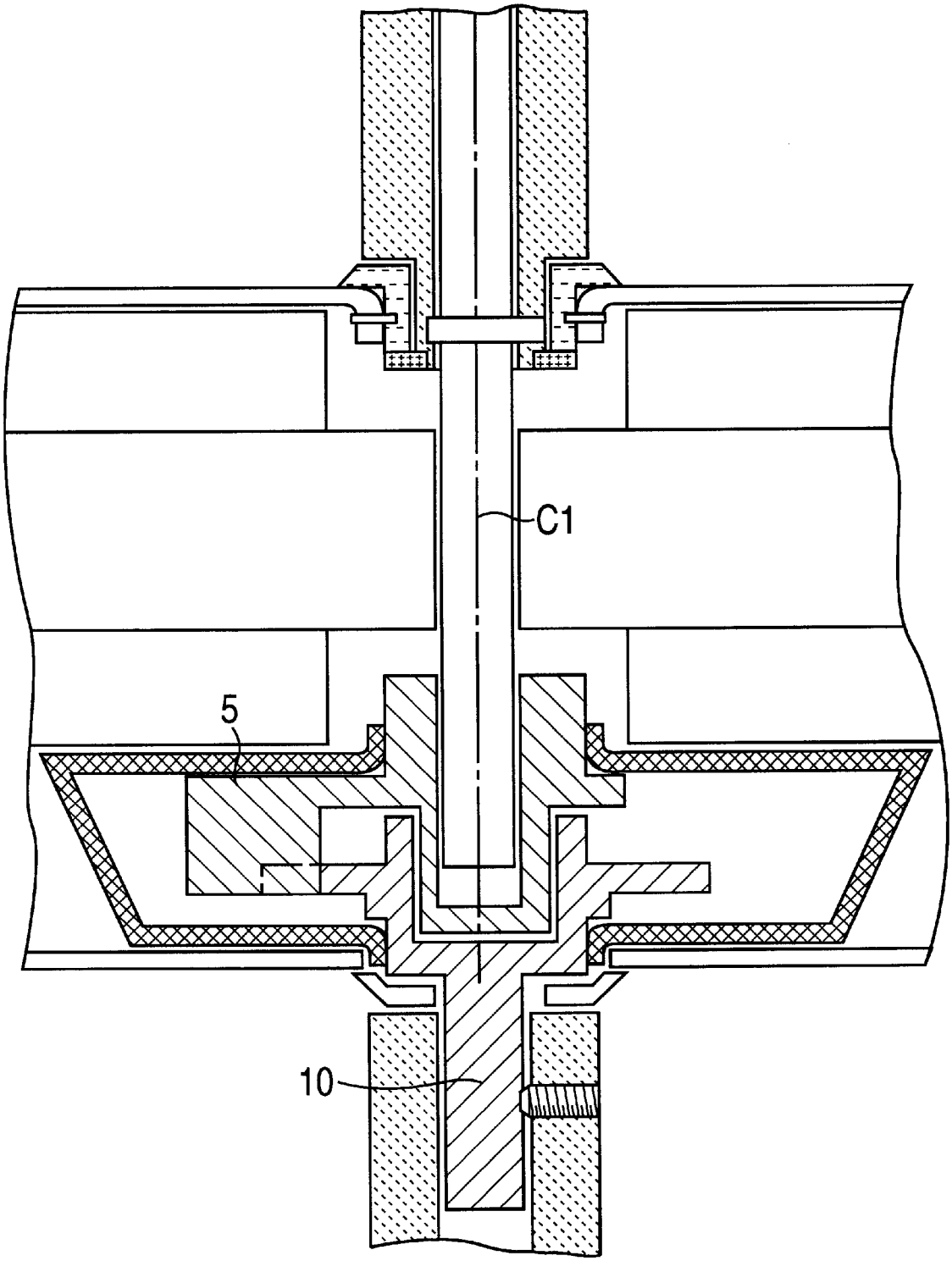

In FIG. 1 there is illustrated a first embodiment of an arrangement in a lock, according to the present invention, wherein reference numeral 1 designates a door handle on the outside of a door 1A (corridor side), and reference numeral 2 designates a door handle on the inside of the door 1A (room side). Reference numeral 3 designates a lock casing, whereas reference numeral 4 designates a turning shaft which transfers the power from any door handle 1, 2 to the lock casing 3, preferably having a square cross section. As appearing from FIG. 1, the shaft 4 extends through the lock casing 3 and into a down comer 5 on the inside of the door 1A. This down comer 5 can be locked by means of an electromotor 6 via a piston 7. This function appears more readily in FIG. 3 wherein the motor 6, the piston 7 and the down comer 5 are seen against the main surface of the door 1A.

Figure 3:
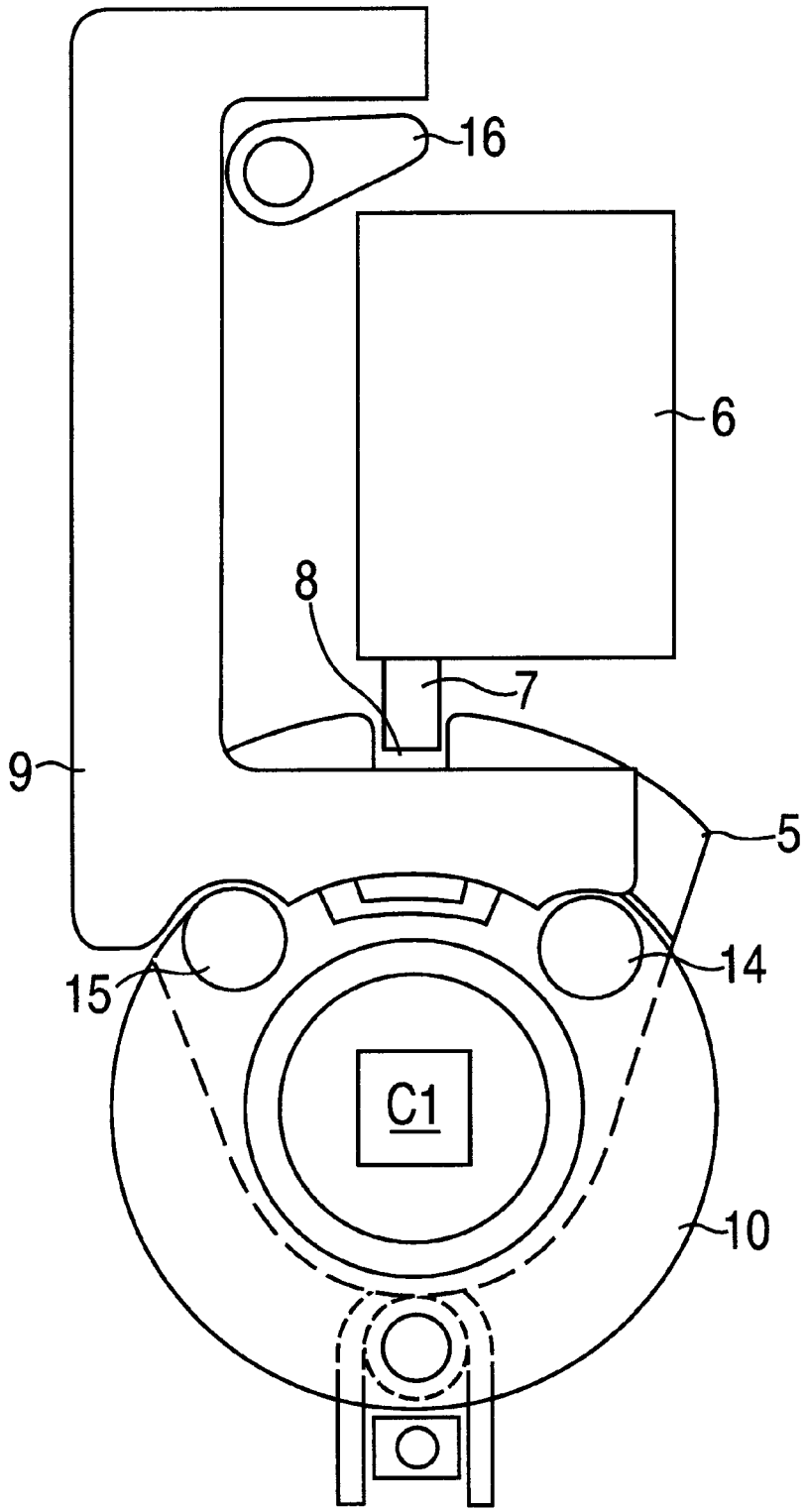
FIG. 3 illustrates the mechanism on the inside of the door, the cover plate thereof being removed.

When the door is shut and locked, the motor 6 retains the piston 7 in a recess 8, see FIG. 3, in the down comer (cam member) 5, for thereby preventing any rotational movement from the outer handle 1 of the door 1A. However, as mentioned previously, it is a requisite that the inner handle always must enable operation of the lock, so as to avoid blocking thereof, i.e. always enabling opening of the door by one-grip-operation, so-called panic opening. This operation can be achieved by letting the inner door handle, i.e. the door handle of the inside of the door, have a free movement in relation to the lock casing of approximately 5–7 degrees before influencing the lock. This free movement or dead angle of the opening movement is utilized to release the electromagnetic blocking of the down comer 5 on the inside of the door. After the release of this blocking a continuous movement of said door lock will influence and open the lock in a usual manner.

Figure 4A:
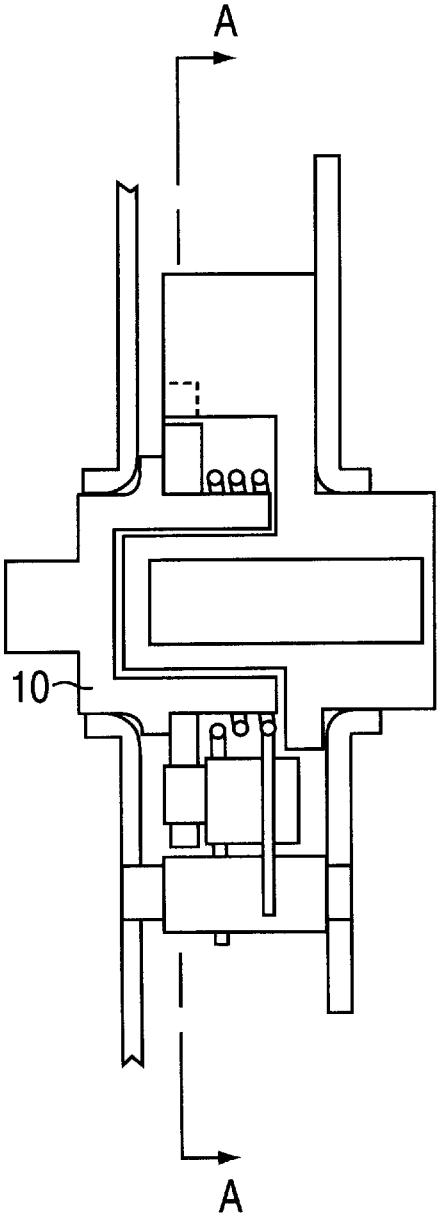
FIG. 4 illustrates the mechanism on the inside of the door, in a simplified manner.
Figure 4B:
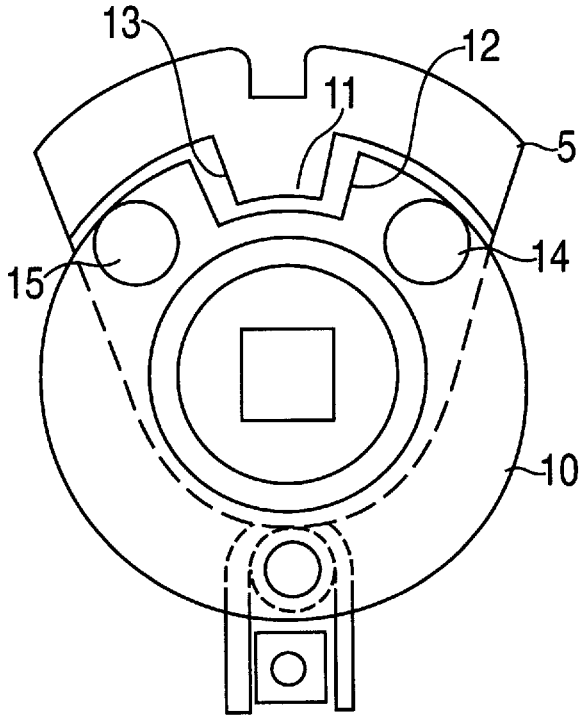

In order to achieve this operation there is on the inner side of the door 1A mounted a release plate 9, see FIG. 3. The door handle 2 on the inside of the door 1A is fixedly attached to an inner down comer 10 which can be rotated in relation to the previously mentioned down comer 5, but which is radially controlled thereby by having a common rotational axis C1. This inner down comer 10 will during the opening of the door 1A move a certain angle released from the down comer 5, until a protrusion 11, see FIG. 4, is touched by the flank 12 or 13 of the inner down comer 10. Thereafter both down comers 5 and 10, as well as the inner parts of the lock casing will be entrained by the further movement. Further, from FIG. 4 it appears that the inner down comer 10 is provided with two taps 14 and 15, which, as appearing from FIG. 3, support the release plate 9. When the door handle 2 is rotated, one of these taps 14 or 15 will lift the release plate 9 which in turn will lift the piston 7 of the electromotor 6 out from the recess 8, so as to release both down comers 5 and 10.

In FIG. 3 there is illustrated an emergency opening mechanism in the form of a third down comer 16. Said third down comer 16 is provided with an elongation which can pass through the door to the corridor side and there be connected with a lock cylinder if an extra possibility for emergency opening from the outside is wanted. Such a solution may be required for obtaining a security against failure in the electromagnetic system which, as a matter of fact, is dependent upon electricity. The outer emergency opening cylinder may be camouflaged since it usually will not be in use.

We claim:

1. In an electromechanical lock system for use on a door of a room, said lock system having a lock case, an outside door handle which faces outside said room, an inside door handle which faces inside said room and an electromagnetic stopper means for blocking rotation of said inside door handle and outside door handle and preventing opening of said door, the improvements comprising:

the electromagnetic stopper means mounted on said door and facing inside said room;

a shaft connected to said outside door handle at one end of said shaft, said shaft extending through said door and locking case and connected to a first cam member at the other end of said shaft, said first cam member facing inside said room, said electromagnetic stopper means blocking rotation of said first cam member, said shaft and said outside door handle thereby preventing opening of the door by said outside door handle; and a second cam member connected to said inside door handle and facing inside said room, said second cam member having first degrees of rotation for releasing the blocking function of said electromagnetic stopper means and second degrees of rotation for rotating said first cam member, said shaft, and said outside door handle after releasing the blocking function of said electromagnetic stopper means, thereby opening said door.

2. The system of claim 1 wherein said first cam member has a recess and said electromagnetic stopper means comprises an electromotor and a piston, said piston fitting into said recess and thereby blocking rotation of said first cam member.

3. The system of claim 1 wherein said first degrees of rotation of said second cam member being about 5–7 degrees.

4. The system of claim 1 further comprising a release means for transferring movement from said second cam member to said electromagnetic stopper means such that during said first degrees of rotation of said second cam member, said second cam member causes the release of the blocking function of said electromagnetic stopper means.

5. The system of claim 4 wherein said release means is a release plate in contact with said electromagnetic stopper means and said second cam member.

6. The system of claim 1 wherein said outside door handle, inside door handle, first cam member and second cam member have a common axis of rotation.

7. The system of claim 1 wherein said second cam member has a slot and said first cam member has a protrusion which extends from said first cam member and into said slot of said second cam member, said slot being greater in width than said protrusion.

8. The system of claim 4 wherein said second cam member has one or more protrusions which are in contact with said release means and cause said release means to move.

* * * * *